US010180131B2

(12) United States Patent
Kim et al.

(10) Patent No.: US 10,180,131 B2
(45) Date of Patent: Jan. 15, 2019

(54) RECIPROCATING COMPRESSOR

(71) Applicant: LG Electronics Inc., Seoul (KR)

(72) Inventors: Dowan Kim, Seoul (KR); Jaeho Cho, Seoul (KR); Yongjin Yang, Seoul (KR); Inho Son, Seoul (KR); Kangkyun Park, Seoul (KR); Jeayoung Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 210 days.

(21) Appl. No.: 14/937,505

(22) Filed: Nov. 10, 2015

(65) Prior Publication Data

US 2016/0131124 A1 May 12, 2016

(30) Foreign Application Priority Data

Nov. 10, 2014 (KR) ..... 10-2014-0155389
Nov. 10, 2014 (KR) ..... 10-2014-0155390
Nov. 10, 2014 (KR) ..... 10-2014-0155493

(51) Int. Cl.
*F04B 39/10* (2006.01)
*F04B 35/01* (2006.01)
*F04B 39/00* (2006.01)

(52) U.S. Cl.
CPC ..... *F04B 39/10* (2013.01); *F04B 35/01* (2013.01); *F04B 39/0061* (2013.01); *F04B 39/1066* (2013.01); *F04B 39/1073* (2013.01)

(58) Field of Classification Search
CPC .. F04B 39/0072; F04B 39/10; F04B 39/1066; F04B 39/14; F04B 39/1073; F04B 39/0061; F04B 39/0027; F04B 39/0066
See application file for complete search history.

(56) References Cited

U.S. PATENT DOCUMENTS 3,469,599 A * 9/1969 Kish ..... F16K 24/02 137/587
5,584,675 A * 12/1996 Steurer ..... F04B 39/066 417/372

(Continued)

FOREIGN PATENT DOCUMENTS

CN 1201502 A * 12/1998
CN 1201502 A 12/1998

(Continued)

OTHER PUBLICATIONS

Machine translation of CN 1201502 A, provided by espacenet, generated Apr. 13, 2018.*

*Primary Examiner* — Philip Stimpert
(74) *Attorney, Agent, or Firm* — Birch, Stewart, Kolasch & Birch, LLP

(57) ABSTRACT

A reciprocating compressor according to an aspect includes a driving unit; a connecting rod; a piston; a cylinder; and a valve assembly, wherein the valve assembly includes a valve plate forming a main body, a suction inlet and a discharge outlet disposed at the valve plate and coming in communication with a compression space of the cylinder to guide a refrigerant flow, a suction valve and a discharge valve disposed at the valve plate and selectively opening the suction inlet and the discharge outlet, and a plurality of coupling portions disposed at the valve plate, and a plurality of corresponding coupling portions disposed to correspond to each of the plurality of coupling portions and preventing the valve assembly from being erroneously assembled are disposed at the cylinder.

4 Claims, 18 Drawing Sheets

(56) References Cited

U.S. PATENT DOCUMENTS

| | | | | |
|---|---|---|---|---|
| 2002/0034450 | A1 | 3/2002 | Svendsen et al. | |
| 2003/0223895 | A1 | 12/2003 | Lee | |
| 2008/0136119 | A1* | 6/2008 | Imai | F16J 15/0831 277/593 |
| 2008/0166250 | A1 | 7/2008 | Iversen et al. | |
| 2010/0290939 | A1* | 11/2010 | Freiberger | F04B 39/10 417/545 |
| 2013/0330214 | A1* | 12/2013 | Freiberger | F04B 39/0027 417/313 |

FOREIGN PATENT DOCUMENTS

| | | | | |
|---|---|---|---|---|
| CN | 1497174 | A | 5/2004 | |
| CN | 1566654 | A | 1/2005 | |
| CN | 1755108 | A | 4/2006 | |
| CN | 102128161 | A | 7/2011 | |
| CN | 104121163 | A | 10/2014 | |
| EP | 1041283 | A2 * | 10/2000 | F04B 39/1066 |
| EP | 1041283 | A2 | 10/2000 | |
| EP | 2280171 | A1 | 2/2011 | |
| JP | 2-134364 | U | 11/1990 | |
| JP | 2013-57284 | A | 3/2013 | |
| KR | 10-2000-0071352 | A | 11/2000 | |
| KR | 10-2010-0085760 | A | 7/2010 | |
| KR | 10-2014-0127081 | A | 11/2014 | |
| WO | WO 2007/128713 | A1 | 11/2007 | |
| WO | WO 2009/090856 | A2 | 7/2009 | |
| WO | WO 2012/108671 | A2 | 8/2012 | |
| WO | WO 2013/016789 | A1 | 2/2013 | |

* cited by examiner

RECIPROCATING COMPRESSOR

CROSS-REFERENCE TO RELATED APPLICATION

This application claims priority under 35 U.S.C. § 119 to Korean Application Nos. 10-2014-0155389, filed in Korea on Nov. 10, 2014, 10-2014-0155390, filed in Korea on Nov. 10, 2014, and 10-2014-0155493, filed in Korea on Nov. 10, 2014, the entire contents of which are hereby incorporated by reference in their entireties.

BACKGROUND

1. Field

The present invention relates, generally, to a reciprocating compressor and, more particularly, to a suction/discharge assembly of a reciprocating compressor.

2. Background

A reciprocating compressor is an apparatus that compresses a fluid by suctioning, compressing, and discharging a refrigerant by a reciprocating motion of a piston inside a cylinder. The reciprocating compressor may be classified as a connected type reciprocating compressor or a vibrating type reciprocating compressor in accordance with a method of driving a piston. Here, the connected type reciprocating compressor compresses a refrigerant by a reciprocating motion inside a cylinder of a piston connected to a rotary shaft of a driving unit through a connecting rod, and the vibrating type reciprocating compressor compresses a refrigerant by a reciprocating motion inside a cylinder of a piston which vibrates by being connected to a mover of a reciprocating motor.

The connected type reciprocating compressor is disclosed in Korean Unexamined Patent Application Publication No. 10-2010-0085760. The connected type reciprocating compressor disclosed in the unexamined patent application includes a housing shell forming a closed space, a driving unit disposed inside the housing shell to provide a driving force, a compression unit connected to a rotary shaft of a driving unit and using the driving force from the driving unit to compress a refrigerant by a reciprocating motion of a piston inside a cylinder, and a suction/discharge unit introducing a refrigerant into the compression unit and discharging a refrigerant compressed by the compression unit.

A suction/discharge part introducing a refrigerant into the cylinder or having a refrigerant compressed in the cylinder introduced thereinto is disposed at the suction/discharge unit. In addition, a valve assembly for guiding suction or discharge of a refrigerant is included between the suction/discharge part and the cylinder.

The valve assembly includes a suction valve and a discharge valve. In a process in which a refrigerant is suctioned and discharged, the suction valve may operate to be open toward the rear with respect to a flowing direction of a refrigerant, and the discharge valve may operate to be open toward the front with respect to the flowing direction of the refrigerant. Consequently, malfunctioning of a valve due to an erroneous direction of assembling the valve assembly may be a problem.

However, a device that guides a direction of assembling a valve assembly is not included in a conventional compressor, and therefore the valve assembly cannot perform its original function when the valve assembly is assembled with front and rear directions thereof reversed.

Meanwhile, a gasket for preventing leakage of a refrigerant is disposed between the valve assembly and the suction/discharge part. The gasket maintains airtightness between the valve assembly and a muffler assembly.

Generally, since a refrigerant inlet and a refrigerant outlet formed at the suction/discharge part have different sizes or shapes from each other, the gasket also has flow holes of different shapes to correspond to the size or shape of the refrigerant inlet and the refrigerant outlet. Consequently, when the gasket is erroneously assembled, problems such as leakage of a refrigerant may occur since the airtightness between the muffler assembly and the cylinder is not maintained.

In addition, the suction/discharge part has to come in close contact with the cylinder and be mounted. However, when a plurality of fastening members are used to couple the suction/discharge part to the cylinder, a structure of a compressor becomes complex and assembling the compressor becomes difficult.

SUMMARY

An aspect of the present invention is to provide a reciprocating compressor which has a structure capable of preventing a valve assembly and a gasket from being erroneously assembled, and using a clamp to integrally couple a suction/discharge unit to a compression unit.

According to an aspect of the present invention, a reciprocating compressor may include a driving unit; a connecting rod; a piston; a cylinder; and a valve assembly, wherein the valve assembly may include a valve plate forming a main body, a suction inlet and a discharge outlet disposed at the valve plate and coming in communication with a compression space of the cylinder to guide a refrigerant flow, a suction valve and a discharge valve disposed at the valve plate and selectively opening the suction inlet and the discharge outlet, and a plurality of coupling portions disposed at the valve plate, and a plurality of corresponding coupling portions disposed to correspond to each of the plurality of coupling portions and preventing the valve assembly from being erroneously assembled may be disposed at the cylinder.

The details of one or more embodiments are set forth in the accompanying drawings and the description below. Other features will be apparent from the description and drawings, and from the claims.

DETAILED DESCRIPTION

Reference will now be made in detail to the embodiments of the present disclosure, examples of which are illustrated in the accompanying drawings.

In the following detailed description of the preferred embodiments, reference is made to the accompanying drawings that form a part hereof, and in which are shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. These terms are not used to define an essence, order or sequence of a corresponding component but used merely to distinguish the corresponding component from other component (s). It should be noted that if it is described in the specification that one component is "connected," "coupled" or "joined" to another component, the former may be directly "connected," "coupled" or "joined" to the latter or "connected," "coupled" or "joined" to the latter via another component.

Figure 1:
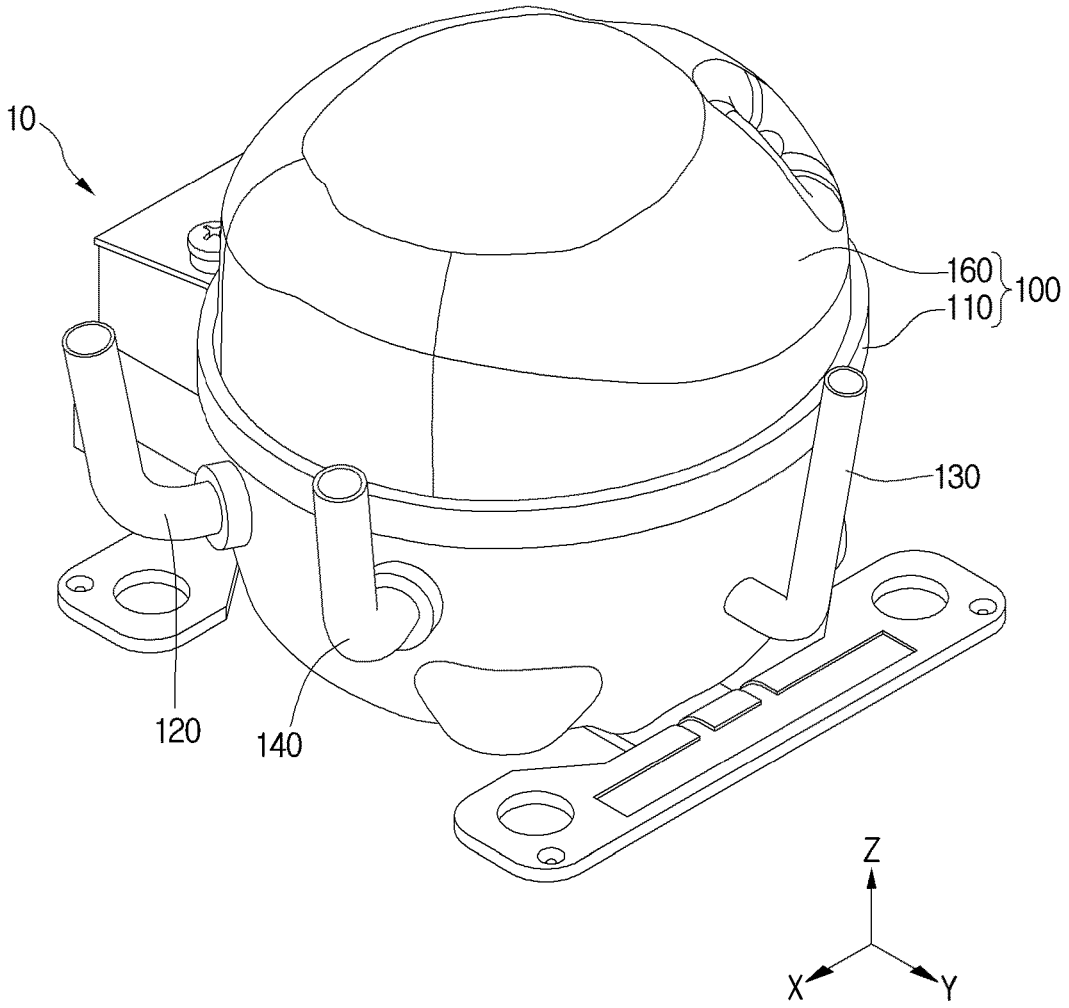
FIG. 1 is a perspective view of a reciprocating compressor according to an embodiment of the present invention.

FIG. 1 is a perspective view of a reciprocating compressor according to an embodiment of the present invention.

Referring to FIG. 1, a reciprocating compressor 10 according to an embodiment of the present invention may include a housing shell 100 forming an exterior.

The housing shell 100 forms a closed space therein, and accommodates various types of parts forming the reciprocating compressor 10 in the closed space. The housing shell 100 may be formed of a metallic material.

The housing shell 100 may include a base shell 110 and a cover shell 160. The base shell 110 and the cover shell 160 are formed in a nearly hemispherical shape and form an accommodation space therein. The cover shell 160 packages the base shell 110 at an upper portion of the base shell 110 to form a closed accommodation space therein.

A suction pipe 120, a discharge pipe 130, and a process pipe 140 may be disposed at the base shell 110.

The suction pipe 120 may introduce a refrigerant into an inner portion of the housing shell 100, and be mounted by penetrating the base shell 110. The suction pipe 120 may be mounted separately from the base shell 110 or be integrally formed with the base shell 110.

The discharge pipe 130 discharges a refrigerant compressed in the housing shell 100, and is mounted by penetrating the base shell 110. The discharge pipe 130 may also be mounted separately from the base shell 110 or integrally formed with the base shell 110.

The process pipe 140 is for charging a refrigerant into an inner portion of the housing shell 100 after sealing the inner portion of the housing shell 100, and may be mounted by penetrating the base shell 110 as the suction pipe 120 and the discharge pipe 130.

The reciprocating compressor 10 may further include a power unit (not shown) disposed at the base shell 110. The power unit (not shown) is for supplying power to various types of parts accommodated inside the housing shell 100, and may be mounted by penetrating the base shell 110.

Figure 2:
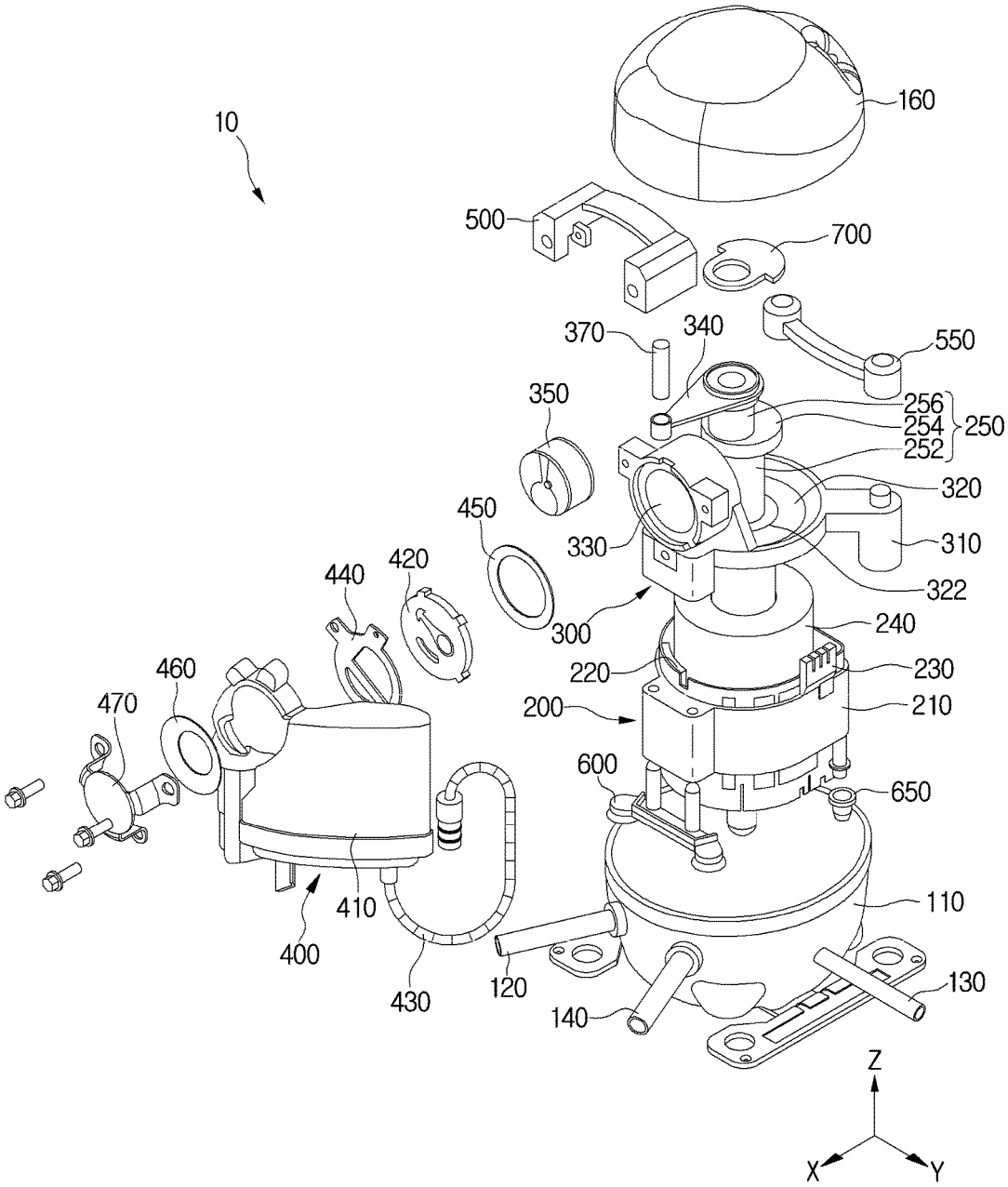
FIG. 2 is an exploded perspective view of the reciprocating compressor in FIG. 1.
Figure 3:
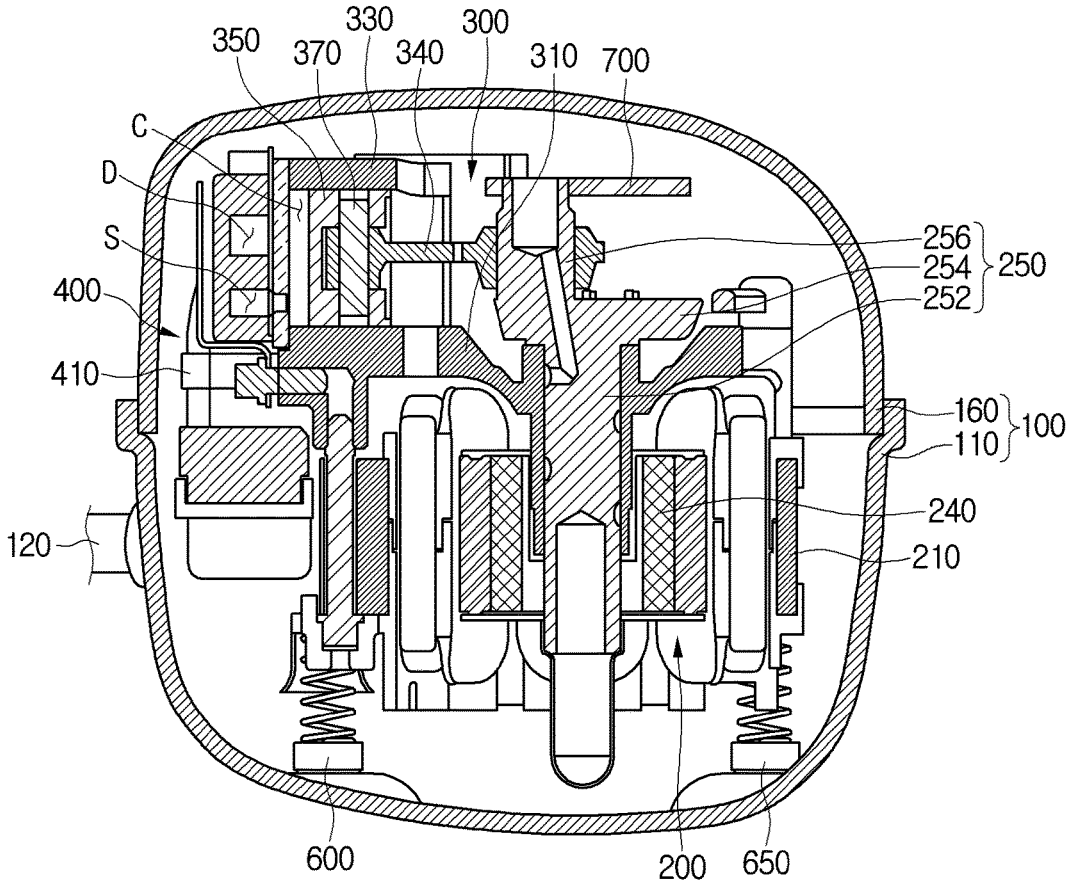
FIG. 3 is a cross-sectional view of the reciprocating compressor in FIG. 1.

FIG. 2 is an exploded perspective view of the compressor in FIG. 1, and FIG. 3 is a cross-sectional view of the compressor in FIG. 1.

Referring to FIGS. 2 and 3, the reciprocating compressor 10 may further include a driving unit or driver 200 disposed in the housing shell 100 and providing a driving force.

The driving unit 200 may include a stator core 210 which corresponds to a portion fixed during an operation of the driving unit 200, and a stator coil 220 mounted inside the stator core 210. The stator core 210 and the stator coil 220 are collectively called a "stator."

The stator core 210 may be formed of a metallic material, and formed in a nearly cylindrical shape.

When voltage is applied from the power unit (not shown), the stator coil 220 may generate an electromagnetic force to perform an electromagnetic interaction with the stator core 210 and a rotor 240 to be described later.

The driving unit 200 may further include an insulator 230 disposed between the stator core 210 and the stator coil 220.

The insulator 230 prevents direct contact between the stator core 210 and the stator coil 220, because if the stator coil 220 comes in direct contact with the stator core 210, generation of an electromagnetic force from the stator coil 220 may be interrupted. To prevent this, the insulator 230 separates the stator core 210 from the stator coil 220 at a predetermined distance.

The driving unit 200 may further include the rotor 240 corresponding to a portion which rotates during the operation of the driving unit 200.

A magnet may be disposed at the rotor 240. Accordingly, when voltage is applied, the rotor 240 rotates by the electromagnetic interaction with the stator core 210 and the stator coil 220.

A rotary force in accordance with the rotation of the rotor 240 acts as a driving force capable of driving a compression unit or compressor 300 to be described later. In other words, in the present embodiment, a driving force of the compression unit 300 may be generated by the rotary force of the rotor 240.

The driving unit 200 may further include a rotary shaft 250 which penetrates the rotor 240 and is mounted inside the rotor 240 along a vertical direction. The rotary shaft 250 may rotate together with the rotor 240 when the rotor 240 rotates.

The rotary shaft 250 may include a base shaft 252, a rotary plate 254, and an eccentric shaft 256.

The base shaft 252 is mounted in the rotor 240 in a vertical direction (z-axis direction). The base shaft 252 rotates together with the rotor 240 in accordance with the rotation of the rotor 240.

The rotary plate 254 is mounted on one end portion of the base shaft 252, and is rotatably mounted on a rotary plate seating unit 320 of a cylinder block 310.

The eccentric shaft 256 is formed by protruding from a top surface of the rotary plate 254. The eccentric shaft 256 protrudes from a position which is eccentric from an axial center of the base shaft 252 to eccentrically rotate when the rotary plate 254 rotates. A connecting rod 340 is mounted on the eccentric shaft 256.

The reciprocating compressor 10 may further include the compression unit 300 disposed inside the housing shell 100 and receiving a driving force from the driving unit 200 to compress a refrigerant by a straight or linear reciprocating motion.

The compression unit 300 includes the cylinder block 310 disposed above the rotor 240.

The cylinder block 310 may include the rotary plate seating unit 320 formed at a lower portion of the cylinder block 310, and a cylinder 330 formed at a front surface portion of the cylinder block 310.

The rotary plate seating unit 320 may rotatably accommodate the rotary plate 254. Furthermore, a shaft opening 322 through which the base shaft 252 may penetrate is formed at the rotary plate seating unit 320.

An opening may be formed at the cylinder 330, and a piston 350 to be described later may be inserted into the cylinder 330 through the opening.

The cylinder 330 may be formed of an aluminum material. The aluminum material may be aluminum or an aluminum alloy. Due to the aluminum material, which is a substantially nonmagnetic substance, a magnetic flux generated in the rotor 240 is not transmitted to the cylinder 330. Accordingly, in the present embodiment, the magnetic flux generated in the rotor 240 may be prevented from being transmitted to the cylinder 330 and leaking outside the cylinder 330.

The compression unit 300 may further include the piston 350 for compressing a refrigerant.

The piston 350 is accommodated inside the cylinder 330 to linearly reciprocate in front and rear directions (x-axis direction). In accordance with the reciprocating motion of the piston 350, a compression space (C) in which a refrigerant introduced from the suction pipe 120 is compressed is formed inside the cylinder 330.

The compression space (C) is a space formed at an inner portion of the cylinder 300, and refers to a space in which a refrigerant flows at a gap portion between the piston 350 and a valve assembly 420.

The piston 350 may be formed of an aluminum material like the cylinder 330. Accordingly, in the present embodiment, a magnetic flux generated in the rotor 240 may be prevented from being transmitted to the piston 350 and leaking outside the piston 350 as in the cylinder 330

Furthermore, as the piston 350 is formed of the same material as the cylinder 330, the piston 350 has a thermal expansion coefficient almost equal to that of the cylinder 330. As the thermal expansion coefficient of the piston 350 is almost equal to that of the cylinder 330, the piston 350 is thermally deformed almost as much as the cylinder 330 in an internal environment of the housing shell 100 at a high temperature (generally, approximately 100° C.) when the reciprocating compressor 10 operates. Accordingly, interference between the piston 350 and the cylinder 330 may be prevented when the piston 350 reciprocates in the cylinder 330.

The compression unit 300 may further include the connecting rod 340 for transmitting a driving force provided from the driving unit 200 to the piston 350. The connecting rod 340 may be formed of a sintered alloy material.

One side of the connecting rod 340 is connected to the rotary shaft 250 to convert a rotary motion transmitted from the rotor 240 into a linear reciprocating motion. Specifically, the connecting rod 340 linearly reciprocates in front and rear directions (x-axis direction) in accordance with eccentric rotation of the eccentric shaft 256.

The other side of the connecting rod 340 is connected to the piston 350. The piston 350 linearly reciprocates in the cylinder 330 in accordance with the linear reciprocating motion of the connecting rod 340.

The compression unit 300 may further include a piston pin 370 for coupling the piston 350 to the connecting rod 340.

Specifically, the piston pin 370 may penetrate the piston 350 and the connecting rod 340 in the vertical direction (z-axis direction) to connect the piston 350 to the connecting rod 340.

The reciprocating compressor 10 may further include a suction/discharge unit or suction/discharge assembly 400 that is disposed inside the housing shell 100, and suctions a refrigerant in order to compress the refrigerant in the compression unit 300 and discharges the compressed refrigerant from the compression unit 300.

The suction/discharge unit 400 may be disposed in front of the compression unit 300 as shown.

In this exemplary embodiment, a term "front" or "front surface portion" signifies a direction from the compression unit 300 toward the suction/discharge unit 400, and a term "rear" or "rear surface portion" signifies the opposite direction. In addition, the term "front" may signify a positive direction of the x-axis, and the term "rear" may signify a negative direction of the x-axis. Unless noted otherwise, the definitions of the directions are identically applied throughout the present specification.

The suction/discharge unit 400 may include a muffler assembly 410.

The muffler assembly 410 transfers a refrigerant suctioned from the suction pipe 120 to an inner portion of the cylinder 330, and transfers a refrigerant compressed in the compression space (C) of the cylinder 330 to the discharge pipe 130. For this, a suction space (S) which accommodates the refrigerant suctioned from the suction pipe 120 and a discharge space (D) which accommodates the refrigerant compressed in the compression space (C) of the cylinder 330 are provided at the muffler assembly 410.

The suction/discharge unit 400 may further include the valve assembly 420 disposed between the cylinder 330 and the muffler assembly 410.

The valve assembly 420 may be assembled to a front surface portion of the cylinder 330, and guide a refrigerant in the suction space (S) to the inner portion of the cylinder 330 or guide a refrigerant compressed in the cylinder 330 to the discharge space (D).

The valve assembly 420 will be described in detail with reference to FIGS. 6 and 7.

The suction/discharge unit 400 may further include a discharge hose 430 disposed at one side of the muffler assembly 410.

The discharge hose 430 may function as a middle passage which transfers a compressed refrigerant accommodated in the discharge space (D) to the discharge pipe 130. One end portion of the discharge hose 430 is mounted on the muffler assembly 410 to come in communication with the discharge space (D), and the other end portion of the discharge hose 430 is mounted to come in communication with the discharge pipe 130.

The suction/discharge unit 400 may include a first gasket 440 mounted between the muffler assembly 410 and the valve assembly 420, and a second gasket 450 mounted between the valve assembly 420 and the cylinder 330. The gaskets 440 and 450 have a function of preventing leakage of a refrigerant.

The first gasket 440 and the second gasket 450 may be formed nearly in the shape of a ring, but the shape is not limited thereto and may be varied as desired so long as the shape is a structure capable of preventing leakage of a refrigerant. The first gasket 440 will be described in detail with reference to FIGS. 11 to 14.

The suction/discharge unit 400 may further include an elastic member 460 mounted in front of the muffler assembly 410.

The elastic member 460 is a device for supporting the muffler assembly 410 during an operation of the reciprocating compressor 10, and the elastic member 460 may be a Belleville spring.

The suction/discharge unit 400 may further include a clamp 470 mounted on a front surface portion of the muffler assembly 410.

The clamp 470 fixes the valve assembly 420, the first gasket 440, the second gasket 450, the elastic member 460, and the muffler assembly 410 to the cylinder block 310. The clamp 470 may be formed nearly in the shape of a trivet, and mounted on the cylinder 330 by a fastener such as a screw.

The reciprocating compressor 10 may include a front damper 500, a rear damper 550, and lower dampers 600 and 650 which buffer vibration and the like of inner structures generated during an operation of the reciprocating compressor 10.

The front damper 500 buffers vibration of the suction/discharge unit 400 and is mounted on a front upper portion of the muffler assembly 410. The front damper 500 may be formed of a rubber material.

The rear damper 550 buffers vibration of the compression unit 300, and is mounted on a rear upper portion of the cylinder block 310. The rear damper 550 may also be formed of a rubber material like the front damper 500.

The lower dampers 600 and 650 buffer vibration of the driving unit 200 and are provided in a plurality. The lower dampers 600 and 650 may include a front lower damper 600 and a rear lower damper 650.

The front lower damper 600 buffers front vibration of the driving unit 200 and is mounted on a front lower portion of the stator core 210. The rear lower damper 650 buffers a rear vibration of the driving unit 200 and is mounted on a rear lower portion of the stator core 210.

The reciprocating compressor 10 may further include a balance weight 700 which is coupled to the eccentric shaft 256 at an upper portion of the connecting rod 340. The balance weight 700 may control rotary vibration when the rotary shaft 250 rotates.

Figure 4:
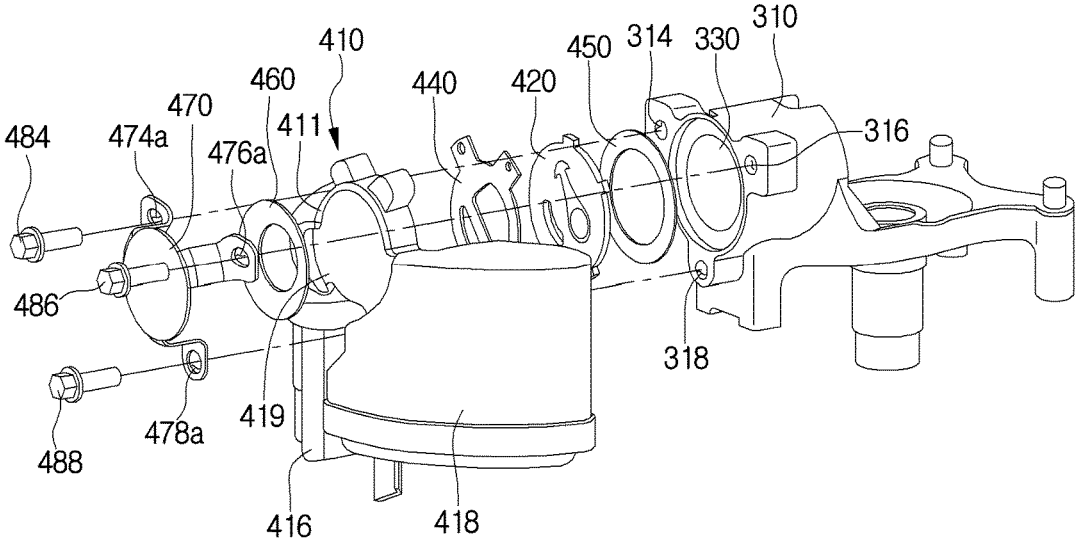
FIGS. 4 and 5 are exploded perspective views of a suction/discharge unit and a muffler assembly.
Figure 5:
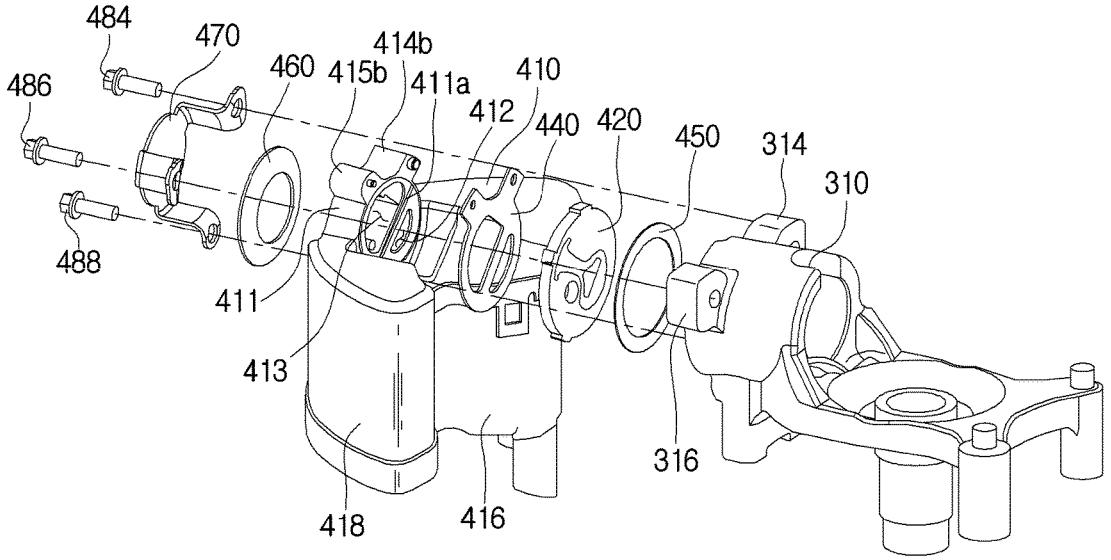

FIGS. 4 and 5 are exploded perspective views of a suction/discharge unit and a muffler assembly.

Referring to FIGS. 4 and 5, the muffler assembly 410, the first gasket 440, the valve assembly 420, and the second gasket 450 are disposed in order between the clamp 470 and the cylinder block 310.

The muffler assembly 410 may further include a suction/discharge part 411 supplying a refrigerant to the cylinder 330 or having a refrigerant compressed in the cylinder 330 introduced thereinto. The suction/discharge part 411 may be formed in a cylindrical shape.

A rear surface portion 411*a* of the suction/discharge part 411 is disposed to face the opening of the cylinder 330. In addition, the rear surface portion 411*a* comes in contact with the first gasket 440. The rear surface portion 411*a* may be formed in a circular shape.

A refrigerant inlet 412 which is a passage through which a refrigerant is supplied to the cylinder 330, and a refrigerant outlet 413 which is a passage into which a refrigerant compressed in the cylinder 330 is introduced are formed at the rear surface portion 411*a* of the suction/discharge part 411.

The muffler assembly 410 may further include a suction muffler 416 connected to one side of the suction/discharge part 411 to suction a refrigerant into an inner portion of the housing shell 100. The suction space (S, refer to FIG. 3) is formed at an inner portion of the suction muffler 416. A refrigerant accommodated in the suction space (S) may be supplied to the cylinder 330 through the refrigerant outlet 413.

The muffler assembly 410 may further include a discharge muffler 418 connected to another side of the suction/discharge part 411 to discharge a refrigerant compressed in the cylinder 330 to the outside of the housing shell 100. The discharge space (D, refer to FIG. 3) is formed at an inner portion of the discharge muffler 418. A refrigerant compressed in the cylinder 330 may be discharged to the discharge space (D) through the refrigerant inlet 412.

The suction muffler 416 and the discharge muffler 418 may be disposed apart from each other. In addition, the suction muffler 416 and the discharge muffler 418 may be mounted apart from each other on an outer circumferential surface of the suction/discharge part 411.

A plurality of protrusions 414*b* and 415*b* for mounting the first gasket 440 may be disposed at the outer circumferential surface of the suction/discharge part 411. The plurality of protrusions 414*b* and 415*b* may include a first protrusion 414*b* and a second protrusion 415*b*. Meanwhile, a number of the plurality of protrusions may be varied if desired.

The clamp 470 may be mounted on the cylinder block 310 by a plurality of fastening members 484, 486, and 488. A plurality of fastening holes 314, 316, and 318 into which the plurality of fastening members 484, 486, and 488 are inserted may be formed at the cylinder block 310.

The clamp 470 includes mount portions 474, 476, and 478 that are seated on the cylinder block 310. Specifically, each of the mount portions 474, 476, and 478 is disposed such that through holes 474*a*, 476*a*, and 478*a* are disposed to sequentially come in communication with the plurality of fastening holes 314, 316, and 318, respectively. Next, the plurality of fastening members 484, 486, and 488 respectively penetrate the through holes 474*a*, 476*a*, and 478*a* to be inserted into the plurality of fastening holes 314, 316, and 318, respectively, and fixed.

Each of the mount portions 474, 476, and 478 may be formed to have a different shape to prevent the clamp 470 from being erroneously assembled. Specifically, each of the mount portions 474, 476, and 478 may be formed in a shape similar to that of a portion of the cylinder block 310 to which they are connected. Accordingly, the through holes 474*a*, 476*a*, and 478*a* may be disposed to sequentially come in communication with the plurality of fastening holes 314, 316, and 318, respectively.

The elastic member 460 for supporting the muffler assembly 410 may be mounted on a front surface portion 419 of the suction/discharge part 411. In addition, the elastic member 460 may be disposed to face a main body portion 471 of the clamp 470.

When the clamp 470 is mounted on the cylinder block 310, one side of the elastic member 460 may be supported by the front surface portion 419, and the other side of the elastic member 460 may be supported by the main body portion 471. Accordingly, the suction/discharge part 411 and the cylinder 330 are brought into close contact with each other by an elastic force of the elastic member 460.

Hereinafter, the valve assembly 420, the cylinder 330, and a coupling relation between the two will be described in detail.

Figure 6:
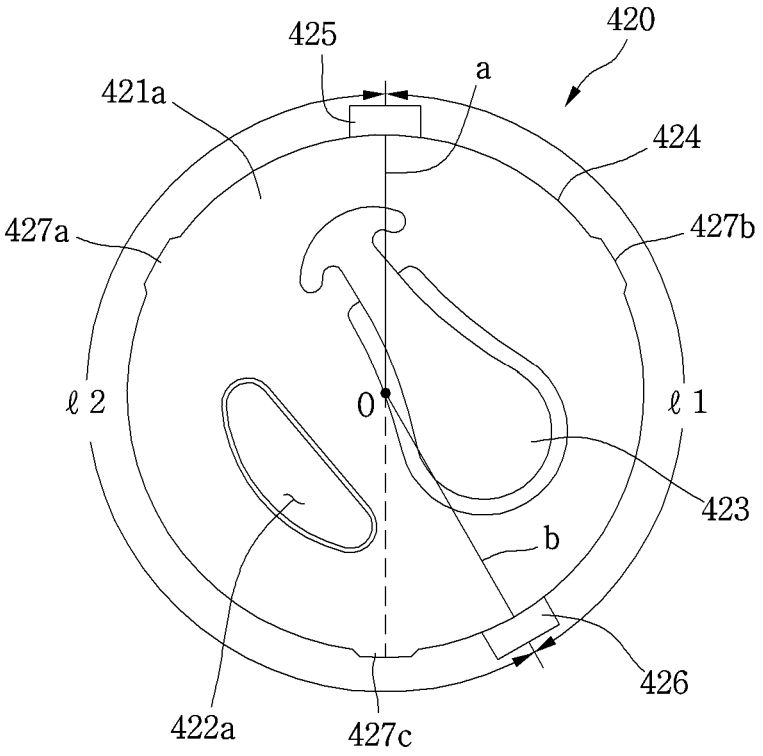
FIGS. 6 and 7 are views illustrating a front surface portion and a rear surface portion of a valve assembly, respectively.
Figure 7:
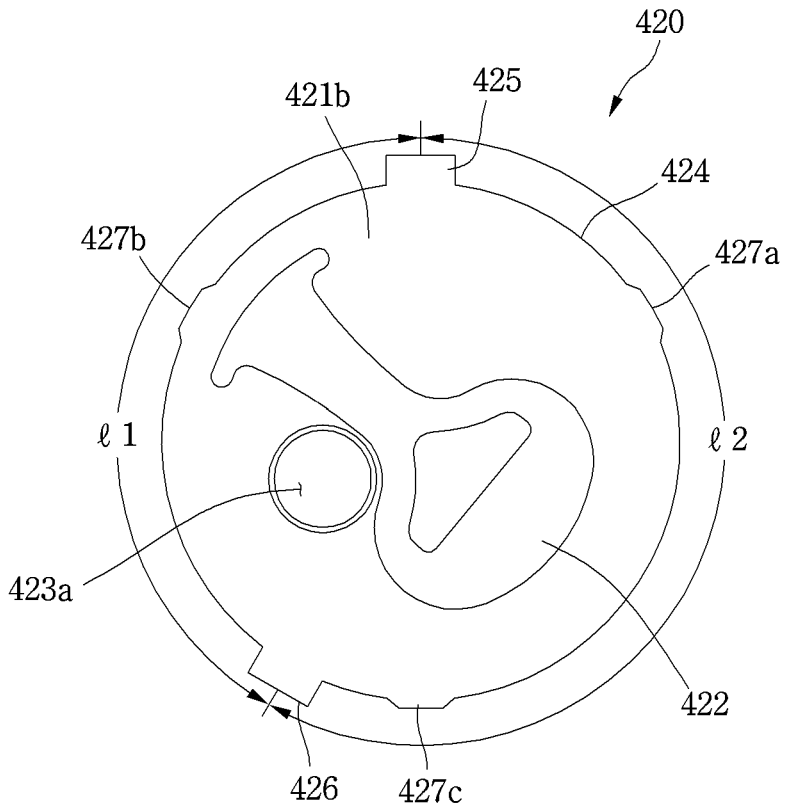
Figure 8:
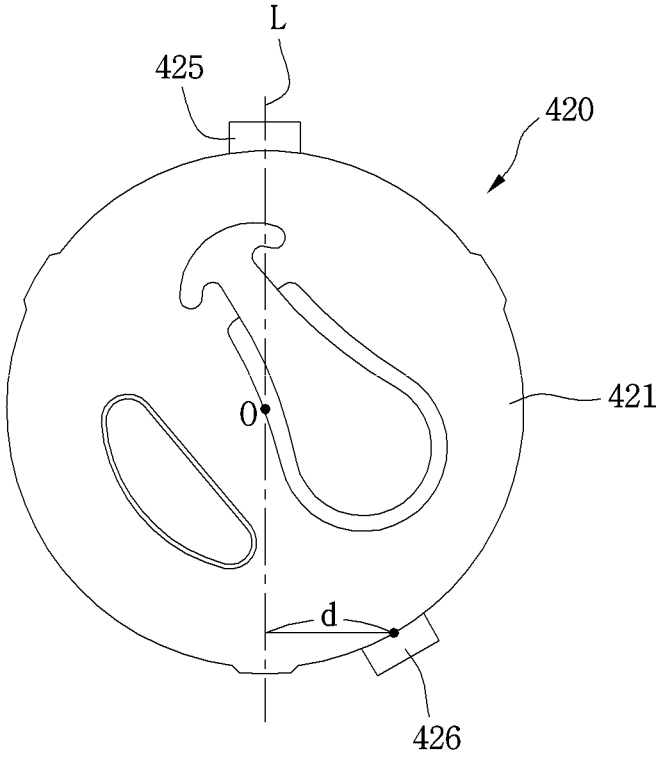
FIG. 8 is a view describing a position relation of a fixing protrusion of the valve assembly.
Figure 9:
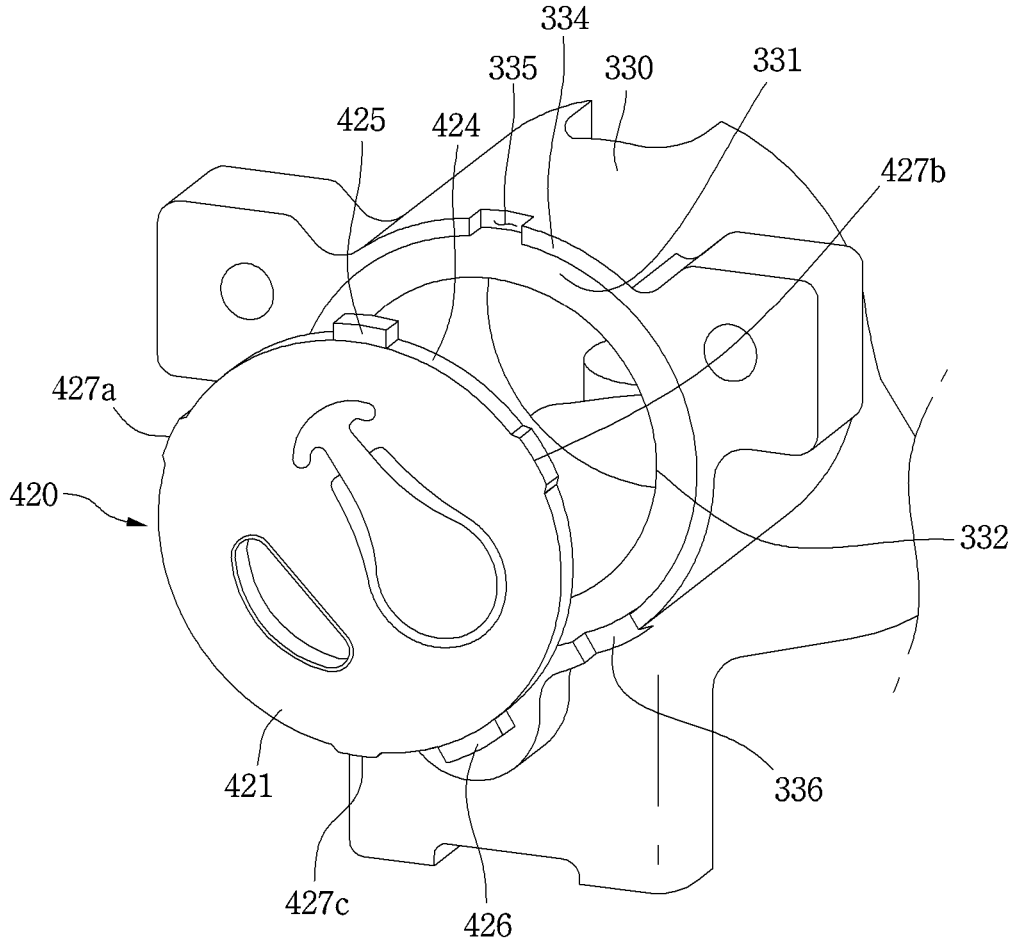
FIGS. 9 and 10 are partial perspective views illustrating a state in which the valve assembly is coupled to a cylinder.
Figure 10:
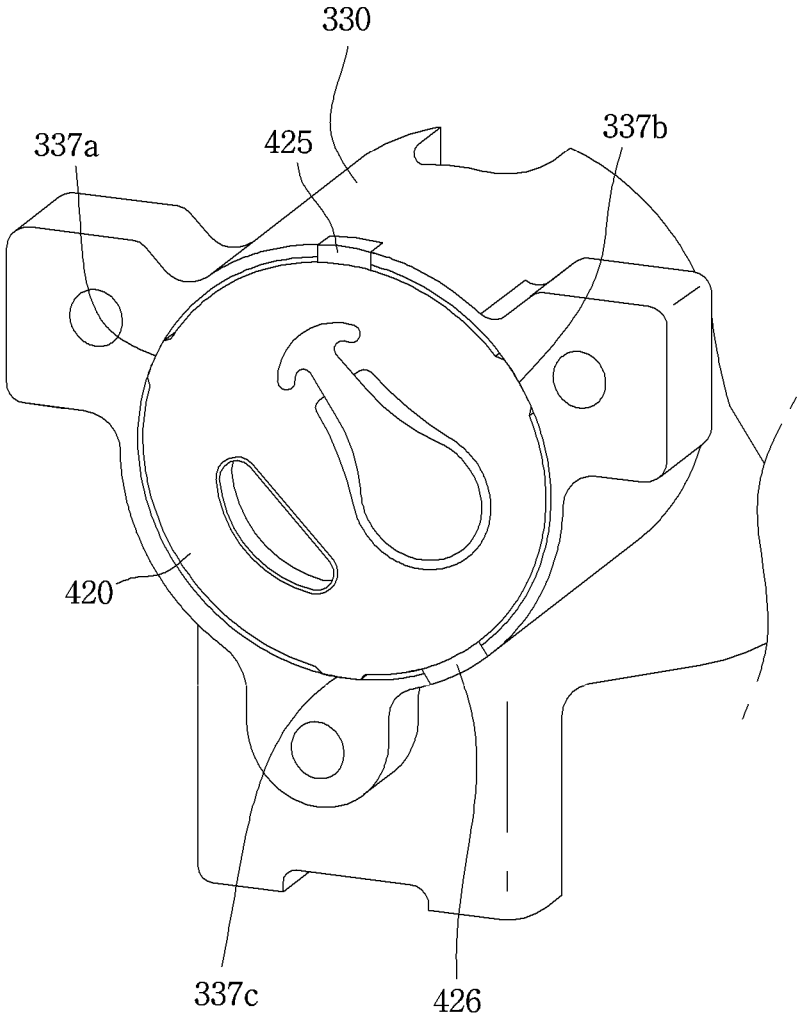

FIG. 6 is a view illustrating a front surface portion of a valve assembly, FIG. 7 is a view illustrating a rear surface portion of the valve assembly, FIG. 8 is a view describing a position relation of a fixing protrusion of the valve assembly, and FIGS. 9 and 10 are partial perspective views illustrating a state in which the valve assembly is coupled to a cylinder.

Referring to FIGS. 6 to 10, the valve assembly 420 includes a valve plate 421 forming a main body. The valve plate 421 may be formed of a circular or oval plate as shown.

A suction inlet 422*a* in communication with the suction space (S) of the muffler assembly 410 to suction a refrigerant in the suction space (S) into the compression space (C) of the cylinder 330 is disposed at the valve plate 421.

The valve assembly 420 may include a suction valve 422 mounted on a rear surface portion 421*b* provided at the rear of the valve plate 421 to open or close the suction inlet 422*a*.

A discharge outlet 423*a* in communication with the discharge space (D) of the muffler assembly 410 to discharge a refrigerant compressed in the compression space (C) to the discharge space (D) is disposed at the valve plate 421.

The valve assembly 420 may include a discharge valve 423 mounted on a front surface portion 421*a* of the valve plate 421 to open or close the discharge outlet 423*a*. Hereinafter, opening and closing processes of the discharge valve 423 and the suction valve 422 will be examined.

When a refrigerant is suctioned into the cylinder 330 from the suction space (S), an inner pressure of the cylinder 330 is lowered in accordance with a backward motion of the piston 350. Accordingly, the suction inlet 422*a* is opened as the suction valve 422 is bent toward the piston 350, and a refrigerant in the suction space (S) is introduced into the compression space (C). Here, the discharge valve 423 closes the discharge outlet 423*a*. Consequently, when the piston 350 moves backward, a refrigerant in the suction space (S) is introduced into the compression space (C), but a refrigerant introduced into the compression space (C) is not discharged to the discharge space (D).

Conversely, when a refrigerant compressed in the compression space (C) in the cylinder 330 is discharged, the discharge outlet 423*a* is opened as the discharge valve 423 is bent toward the discharge space (D), and a refrigerant in the compression space (C) is discharged to the discharge space (D). Here, the suction valve 422 closes the suction inlet 422*a*. Consequently, the refrigerant compressed in the cylinder 330 may be discharged to the discharge space (D) instead of being discharged to the suction space (S).

To enable the reciprocating compressor 10 to function, it is important that a refrigerant flow through the suction space (S), the compression space (C), and the discharge space (D) in that order. If the valve assembly 420 is assembled to the cylinder 330 with front and rear directions thereof reversed, a problem may occur since a refrigerant flow is changed.

To prevent an erroneous assembly as described above, the valve assembly 420 may further include a plurality of fixing protrusions 425 and 426. The plurality of fixing protrusions 425 and 426 may be configured to ensure that front and rear assembling directions are not reversed when the valve assembly 420 is assembled to the cylinder 330.

The plurality of fixing protrusions 425 and 426 may include a first fixing protrusion 425 disposed at one side of an edge portion 424, and a second fixing protrusion 426 disposed to be a predetermined interval apart from the first fixing protrusion 425. The first fixing protrusion 425 and the second fixing protrusion 426 may be formed with different widths or sizes from each other.

Specifically, an arrangement relation between the first fixing protrusion 425 and the second fixing protrusion 426 will be described.

A distance from a central portion of the first fixing protrusion 425 to a central portion of the second fixing protrusion 426 which extends clockwise along the edge portion 424 may be called l1, and the distance which extends counterclockwise may be called l2. Here, the first fixing protrusion 425 and the second fixing protrusion 426 may be disposed such that l is shorter than l2 (see FIG. 6).

In addition, the arrangement relation between the first fixing protrusion 425 and the second fixing protrusion 426 may be described in terms of an angle.

A segment connecting the center (o) of the valve plate 421 to the central portion of the first fixing protrusion 425 may be "a," and a segment connecting the center (o) of the valve plate 421 to the second fixing protrusion 426 may be "b." Here, the first fixing protrusion 425 and the second fixing protrusion 426 may be disposed such that the angle between the segments "a" and "b" is less than 180° (see FIG. 7).

In addition, the central portion of the second fixing protrusion 426 and the central portion of the first fixing protrusion 425 are disposed a predetermined distance (d) from a vertical line (L) passing through the center (o) of the valve plate 421. There are no limitations in the predetermined distance (d) as long as the length of the predetermined distance (d) is greater than 0 and equal to or shorter than a radius of the valve plate 421 (see FIG. 8).

As the first fixing protrusion 425 and the second fixing protrusion 426 are disposed as described above, shapes of the exteriors of the front surface portion 421*a* and the rear surface portion 421*b* of the valve assembly 420 do not overlap.

The valve assembly 420 may further include contact protrusions 427*a*, 427*b*, and 427*c* which protrude from the edge portion 242.

The contact protrusions 427*a*, 427*b*, and 427*c* may be disposed at equidistant intervals of 120°. However, the number and arrangement angle of the contact protrusions 427*a*, 427*b*, and 427*c* are not limited thereto and may be varied is desired.

The contact protrusions 427*a*, 427*b*, and 427*c* may be formed with smaller widths or sizes than the plurality of fixing protrusions 425 and 426.

Hereinafter, a coupling structure between the valve assembly 420 and the cylinder 330 will be described in detail.

The cylinder 330 may include a planar portion or section 331 on which the valve assembly 420 is seated.

Since the diameter of the valve plate 421 is smaller than the diameter of an opening 332 of the cylinder 330, the rear surface portion 421*b* of the valve plate 421 may be supported by the planar portion 331 when the valve assembly 420 is coupled to the cylinder 330.

The cylinder 330 may further include an assembly fixing portion 334 formed by protruding from the planar portion 331.

The assembly fixing portion 334 surrounds the edge portion 424 of the valve assembly 420. In addition, the contact protrusions 427*a*, 427*b*, and 427*c* may come in direct contact with the assembly fixing portion 334.

The contact protrusions 427*a*, 427*b*, and 427*c* may respectively come in contact with contact portions 337*a*, 337*b*, and 337*c* of the assembly fixing portion 334 to prevent the valve assembly 420 from moving. Accordingly, the assembled state between the valve assembly 420 and the cylinder 330 may be firmly maintained.

A plurality of protrusion grooves 335 and 336 formed at positions corresponding to each of the fixing protrusions 425 and 426 may be disposed at the assembly fixing portion 334 when the valve assembly 420 is coupled to the cylinder 330.

The plurality of protrusion grooves 335 and 336 may include a first protrusion groove 335 coupled to the first fixing protrusion 425, and a second protrusion groove 336 coupled to the second fixing protrusion 426. The plurality of protrusion grooves 335 and 336 may have shapes respectively corresponding to those of the plurality of fixing protrusions 425 and 426.

The width of the first fixing protrusion 425 may be different from that of the second fixing protrusion 426 so that the plurality of fixing protrusions 425 and 426 and the plurality of protrusion grooves 335 and 336 are respectively coupled at corresponding positions. For example, the width of the first fixing protrusion 425 may be wider or narrower than the width of the second fixing protrusion 426. However, the shape and size of the first fixing protrusion 425 and the second fixing protrusion 426 are not limited as long as the first fixing protrusion 425 cannot be inserted into the second protrusion groove 336, and the second fixing protrusion 426 cannot be inserted into the first protrusion groove 335.

The plurality of fixing protrusions 425 and 426 may be called a "plurality of coupling portions." Here, the first fixing protrusion 425 may be called a "first coupling portion," and the second fixing protrusion 426 may be called a "second coupling portion." In addition, the plurality of protrusion grooves 335 and 336 may be called a "plurality of corresponding coupling portions." Here, the first protrusion groove 335 into which the first fixing protrusion 425 is inserted may be called a "first corresponding coupling portion," and the second protrusion groove 336 into which the second fixing protrusion 426 is inserted may be called a "second corresponding coupling portion."

Meanwhile, the valve plate may further include an additional fixing protrusion in addition to the plurality of fixing protrusions 425 and 426. Here, the cylinder 330 may further include a protrusion groove corresponding to the additional fixing protrusion.

While in this first embodiment, it was described that the plurality of fixing protrusions 425 and 426 are included at the valve assembly 420, and the plurality of protrusion grooves 335 and 336 are formed at the cylinder 330, the arrangement of the fixing protrusions and grooves could be varied.

For example, a plurality of protrusion grooves (not shown) may be formed at the edge portion 424 of the valve assembly 420, and a plurality of fixing protrusions formed at positions corresponding to the plurality of protrusion grooves (not shown) may be formed at the assembly fixing portion 334 of the cylinder 330. However, it may be preferable that the plurality of fixing protrusions 425 and 426 be formed at the valve assembly 420, and the plurality of protrusion grooves 335 and 336 be formed at the cylinder 330.

As another alternative, one fixing protrusion and one protrusion groove may be formed at the edge portion 424. Here, a protrusion groove or a fixing protrusion corresponding to each of the one fixing protrusion and the one protrusion groove may be formed at the assembly fixing portion 334.

For example, the second fixing protrusion 426 of the edge portion 424 in the first embodiment may be changed into a protrusion groove. Consequently, in the present embodiment, the first fixing protrusion 425 is formed at the edge portion 424, and the first protrusion groove 335 into which the first fixing protrusion 425 is inserted is formed at the assembly fixing portion 334 as in the first embodiment. However, a protrusion groove may be formed at the edge portion 424, and a fixing protrusion corresponding to the protrusion groove may be formed at the assembly fixing portion 334.

The plurality of fixing protrusions 425 and 426 or a plurality of protrusion grooves formed at the valve assembly 420 may be collectively called a "plurality of coupling portions," and a plurality of fixing protrusions or the plurality of protrusion grooves 335 and 336 formed at the cylinder 330 at positions respectively corresponding to the plurality of coupling portions may be collectively called a "plurality of corresponding coupling portions."

The valve assembly 420 may be prevented from being erroneously assembled with front and rear surfaces thereof reversed when the valve assembly 420 is coupled to the cylinder 330 by the plurality of coupling portions and the plurality of corresponding coupling portions.

According to the present invention, erroneously assembling of a valve assembly may be prevented when the valve assembly is assembled to a cylinder.

Hereinafter, a structure for preventing the first gasket 440 from being erroneously assembled will be described in detail. For convenience of the description, the first gasket 440 may be called a gasket 440, and the second gasket 450 may be called a suction gasket 450.

Figure 11:
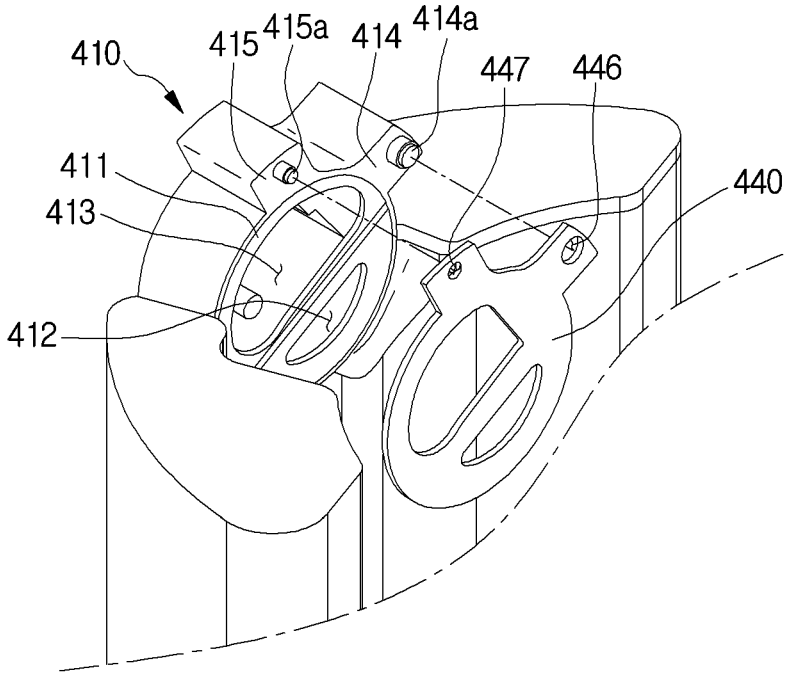
FIGS. 11 and 12 are views for describing states of the reciprocating compressor in FIG. 1 before and after a gasket is fastened to the muffler assembly.
Figure 12:
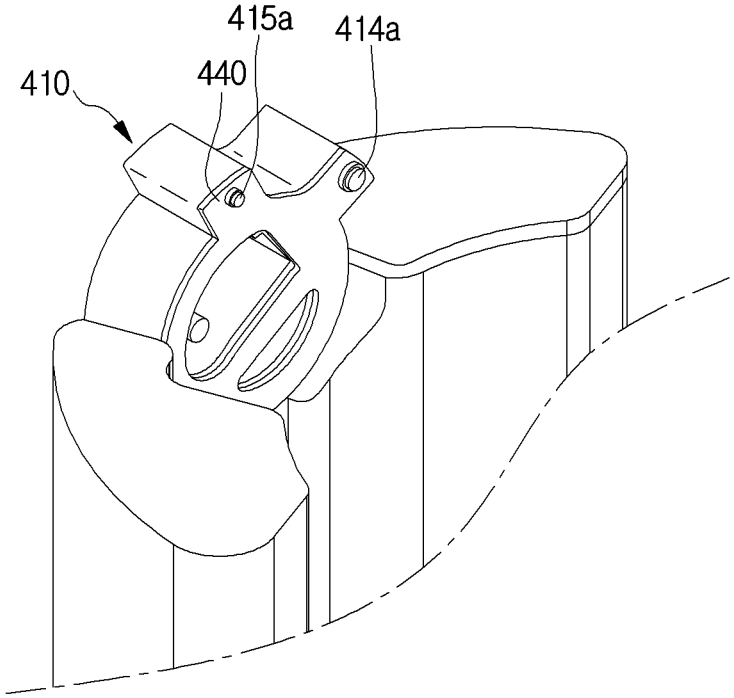
Figure 13:
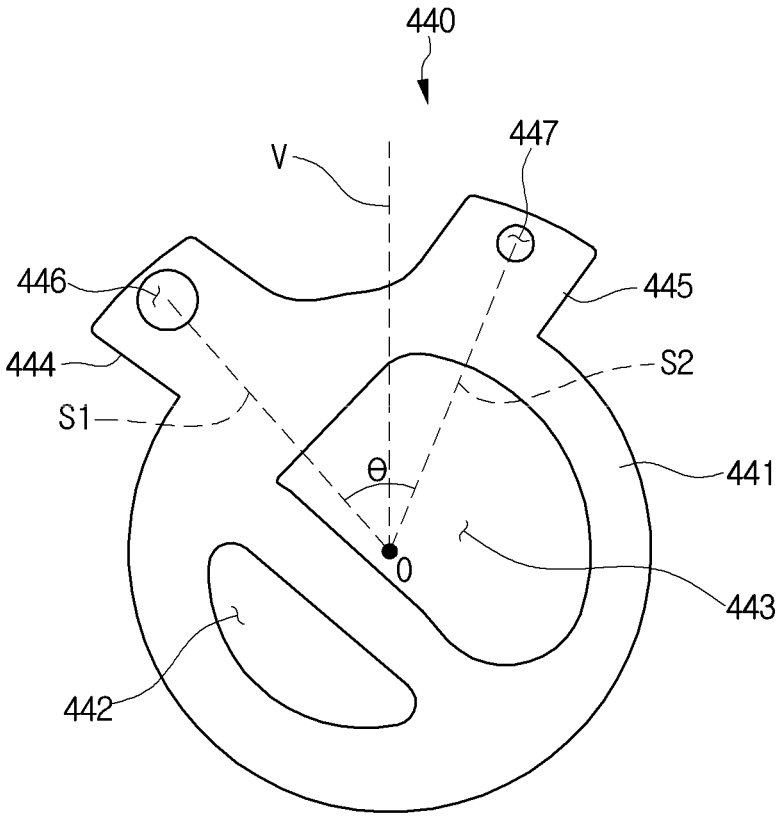
FIG. 13 is a front view of the gasket in FIG. 11.
Figure 14:
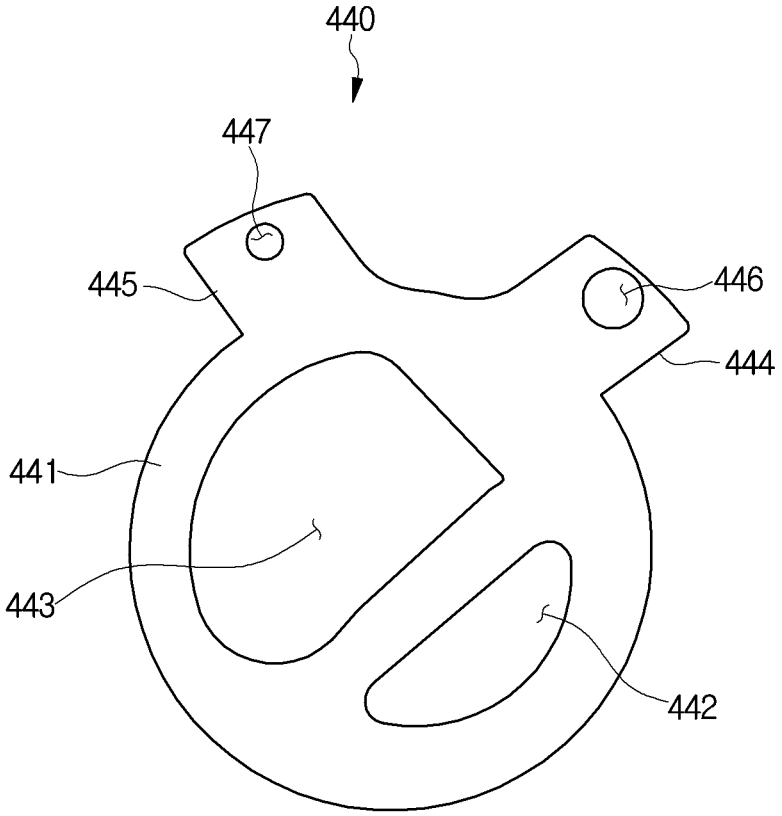
FIG. 14 is a rear view of the gasket in FIG. 11.

FIGS. 11 and 12 are views for describing states of the reciprocating compressor in FIG. 1 before and after a gasket is fastened to a muffler assembly, FIG. 13 is a front view of the gasket in FIG. 11, and FIG. 14 is a rear view of the gasket in FIG. 11.

Referring to FIGS. 11 to 14, the gasket 440, the valve assembly 420, and the suction gasket 450 may be sequentially coupled to the muffler assembly 410. The valve assembly 420 guides a refrigerant discharged from the muffler assembly 410 to the cylinder 330, or guides a refrigerant compressed in the cylinder 330 to the muffler assembly 410. The gasket 440 prevents leakage of a refrigerant flowing between the muffler assembly 410 and the valve assembly 420. In addition, the suction gasket 450 prevents leakage of a refrigerant flowing between the valve assembly 420 and the cylinder 330.

The muffler assembly 410 includes the suction/discharge part 411 with which the gasket 440 comes in contact. The suction/discharge part 411 may be formed in a circular or oval shape, but the shape is not limited thereto.

A refrigerant inlet 412 for supplying a refrigerant to the cylinder 330 may be formed at the suction/discharge part 411. The refrigerant inlet 412 may be in communication with the suction space (S). In addition, a refrigerant flow between the refrigerant inlet 412 and the cylinder 330 may be guided by the valve assembly 420.

A refrigerant outlet 413 for discharging a refrigerant compressed in the cylinder 330 may be formed at the suction/discharge part 411. The refrigerant outlet 413 may be in communication with the compression space (C). In addition, a refrigerant flow between the refrigerant outlet 413 and the cylinder 330 may be guided by the valve assembly 420.

The refrigerant outlet 413 may be formed to be greater in size than the refrigerant inlet 412 because a pressure at which a refrigerant compressed in the cylinder 330 is discharged to the refrigerant outlet 413 is greater than a pressure at which a refrigerant is introduced into the cylinder 330 from the refrigerant inlet 412.

In addition, the suction/discharge part 411 may further include a plurality of protruding surfaces 414 and 415 configured to extend from an outer edge of the suction/discharge part 411. In the description of the present embodiment, it will be assumed that two protruding surfaces 414 and 415 are disposed. The two protruding surfaces 414 and 415 may include a first protruding surface 414 and a second protruding surface 415 apart from the first protruding surface 414.

The first protruding surface 414 and the second protruding surface 415 may be disposed to extend parallel to an axis of the suction/discharge part 411. Furthermore, the first protruding surface 414 and the second protruding surface 415 may have a predetermined height difference from the suction/discharge part 411.

The muffler assembly 410 may further include a plurality of fastening protrusions 414*a* and 415*a* disposed at the plurality of protruding surfaces 414 and 415 to protrude toward the cylinder 330.

The plurality of fastening protrusions 414*a* and 415*a* may include a first fastening protrusion 414*a* configured to protrude from the first protruding surface 414 toward the cylinder 330, and a second fastening protrusion 415*a* configured to protrude from the second protruding surface 415 toward the cylinder 330.

However, a number of the plurality of fastening protrusions 414*a* and 415*a* is not limited to two, and may be varied if desired. For example, three or four fastening protrusions may be formed.

In addition, although not shown, the plurality of fastening protrusions 414*a* and 415*a* may be formed not only at the plurality of protruding surfaces 414 and 415, but also at the cylinder 330. In this case, the plurality of fastening protrusions 414*a* and 415*a* may be formed at an upper portion of the cylinder 330.

The first fastening protrusion 414*a* and the second fastening protrusion 415*a* may be formed in cylindrical shapes of different sizes. Specifically, a diameter of a cross-sectional portion of the first fastening protrusion 414*a* may be formed greater than a diameter of a cross-sectional portion of the second fastening protrusion 415*a*. Conversely, the diameter of the cross-sectional portion of the second fastening protrusion 415*a* may be formed greater than the diameter of the cross-sectional portion of the first fastening protrusion 414*a*.

The first fastening protrusion 414*a* and the second fastening protrusion 415*a* may be respectively fitted into a plurality of erroneous assembly prevention holes 446 and 447. Accordingly, the gasket 440 may be coupled to the muffler assembly 410 in a proper orientation.

The gasket 440 includes a main body portion 441. The main body portion 441 may be formed in the shape of a thin circular or oval plate as shown in the drawings, but the shape is not limited thereto.

The gasket 440 may further include a first flow hole 442 and a second flow hole 443 being in communication with the refrigerant inlet 412 and the refrigerant outlet 413, respectively. A refrigerant in the suction space (S) may flow to the cylinder 330 through the first flow hole 442, and a refrigerant compressed in the cylinder 330 may flow to the discharge space (D) through the second flow hole 443. The first flow hole 442 and the second flow hole 443 may be formed in shapes corresponding to the refrigerant inlet 412 and the refrigerant outlet 413, respectively.

The gasket 440 may further include a first coupling portion 444 and a second coupling portion 445 extending from one side of the main body portion 441 in a radial direction of the main body portion 441. The first coupling portion 444 and the second coupling portion 445 may be formed in the shape of a thin plate which is level with the main body portion 441. In addition, the first coupling portion 444 and the second coupling portion 445 may be disposed apart from each other.

The gasket 440 may further include a first erroneous assembly prevention hole 446 disposed at the first coupling portion 444 and a second erroneous assembly prevention hole 447 disposed at the second coupling portion 445.

The first erroneous assembly prevention hole 446 and the second erroneous assembly prevention hole 447 may be formed by penetrating the first coupling portion 444 and the second coupling portion 445, respectively. The first erroneous assembly prevention hole 446 and the second erroneous assembly prevention hole 447 may be formed in a circular shape, and be formed in different sizes.

The first erroneous assembly prevention hole 446 and the second erroneous assembly prevention hole 447 may have the shapes and sizes corresponding to the first fastening protrusion 414*a* and the second fastening protrusion 415*a*, respectively. Consequently, the first fastening protrusion 414*a* is not fitted into the second erroneous assembly prevention hole 447, and the second fastening protrusion 415*a* is not fitted into the first erroneous assembly prevention hole 446 and the gasket 440 may be prevented from being erroneously assembled with the front and rear directions thereof reversed when the gasket 440 is assembled to the muffler assembly 410.

A segment (s1) connecting the center of the first erroneous assembly prevention hole 446 to the center (O) of the main body portion 441 and a segment (s2) connecting the center of the second erroneous assembly prevention hole 447 to the center (O) of the main body portion 441 may be disposed to lean from opposites to a center line (v) of the gasket 440.

In addition, an angle θ between the segment (s1) and the segment (s2) is less than 180° because, if the angle between the two segments (s1, s2) is equal to 180°, the gasket 440 may be erroneously assembled even if the size of the first erroneous assembly prevention hole 446 and the size of the second erroneous assembly prevention hole 447 are different from each other.

In addition, a load of the gasket 440 may be supported when the first fastening protrusion 414*a* and the second fastening protrusion 415*a* are fitted into the first erroneous assembly prevention hole 446 and the second erroneous assembly prevention hole 447. Consequently, a separate gasket fixing member is not required and assembling the gasket 440 becomes easy.

While in this embodiment, the plurality of erroneous assembly prevention holes 446 and 447 are described as being disposed at the plurality of coupling portions 444 and 445, it is understood that a plurality of erroneous assembly prevention holes 446 and 447 may be disposed at the main body portion 441.

Alternatively, the plurality of fastening protrusions 414*a* and 415*a* may be disposed in shapes corresponding to positions respectively corresponding to the plurality of erroneous assembly prevention holes 446 and 447 on an upper portion of the suction/discharge part 411.

In other words, the plurality of erroneous assembly prevention holes 446 and 447 need not be disposed at the separate coupling portions 444 and 445 as long as the structure does not allow the gasket 440 to be erroneously assembled with front and rear directions thereof reversed. However, it may be preferable for the erroneous assembly prevention holes 446 and 447 to be disposed at the plurality of coupling portions 444 and 445 in terms of a function of the gasket 440 of preventing leakage of a refrigerant.

In addition, while in this embodiment, it was described that the plurality of erroneous assembly prevention holes 446 and 447 are formed in a circular shape. However, it is understood that each of the plurality of erroneous assembly prevention holes 446 and 447 may have a different shape.

For example, the first erroneous assembly prevention hole 446 may be formed in a circular shape, and the second erroneous assembly prevention hole 447 may be formed in a rectangular or triangular shape. Here, the plurality of fastening protrusions 414*a* and 415*a* are formed in shapes respectively corresponding to the plurality of erroneous assembly prevention holes 446 and 447. There is no limitation to the types of shapes as long as the plurality of erroneous assembly prevention holes 446 and 447 are formed in different shapes.

Accordingly, the first fastening protrusion 414*a* is fitted only into the first erroneous assembly prevention hole 446 without being fitted into the second erroneous assembly prevention hole 447, and the second fastening protrusion 415*a* is fitted into the second erroneous assembly prevention hole 447.

The reciprocating compressor 10 according to the present embodiment prevents the gasket 440 from being erroneously assembled, thereby reliably maintaining airtightness between the cylinder 330 and the muffler assembly 410. Accordingly, the reciprocating compressor 10 according to the present embodiment is capable of preventing leakage of a flowing refrigerant and promoting a smooth refrigerant flow.

Hereinafter, a structure of the clamp 470 will be described in detail.

Figure 15:
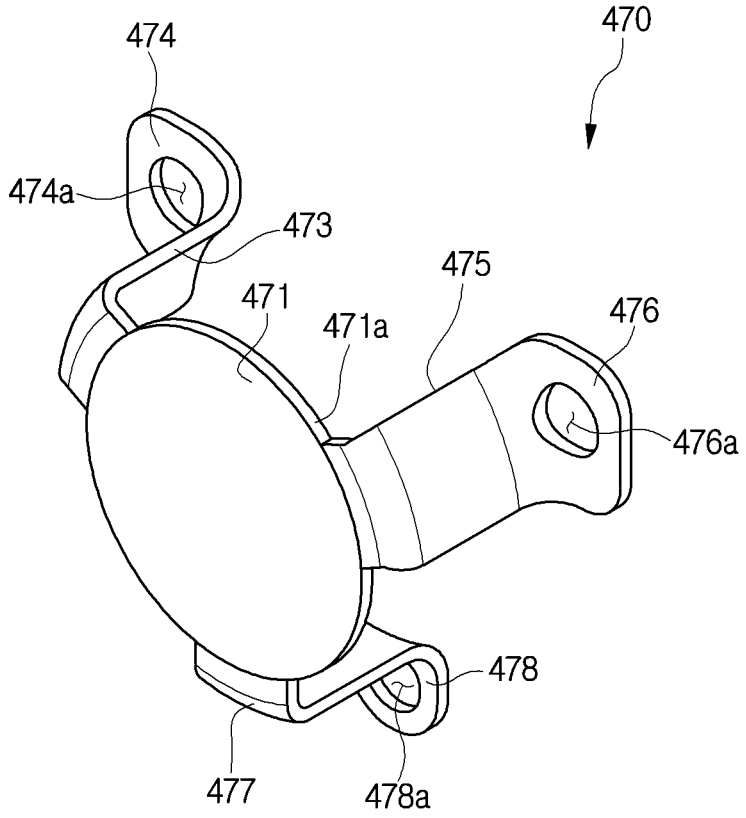
FIG. 15 is a perspective view of a clamp in FIG. 2.
Figure 16:
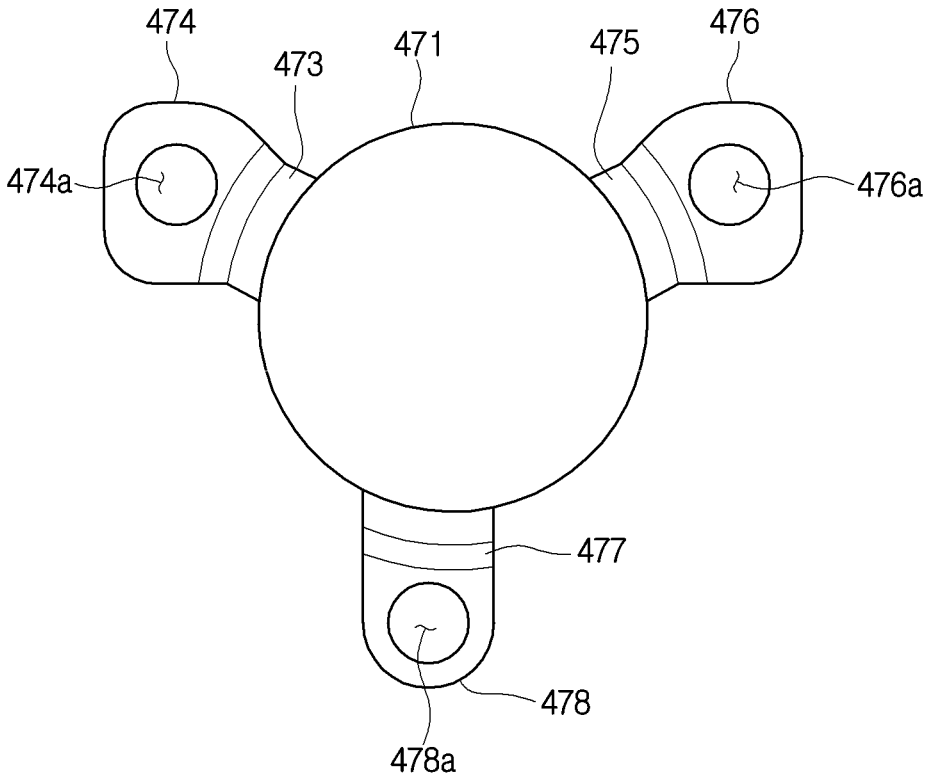
FIG. 16 is a front view of the clamp in FIG. 1.

FIG. 15 is a perspective view of the clamp in FIG. 2, and FIG. 16 is a front view of the clamp in FIG. 15.

Referring to FIGS. 15 and 16, the clamp 470 according to an embodiment of the present invention includes a main body portion 471 disposed in front of the suction/discharge unit 400 (see FIG. 2). The main body portion 471 may be formed in the shape of a thin circular or oval plate. However, the shape of the main body portion 471 is not limited thereto.

The clamp 470 may further include a plurality of legs 473, 475, and 477 extending from the main body portion 471 toward the cylinder 330 (see FIG. 2). Each of the legs 473, 475, and 477 may extend from an edge portion 471*a* forming an outer circumferential surface of the main body portion 471. Specifically, the legs 473, 475, and 477 are disposed apart from each other in a circumferential direction of the edge portion 471*a*.

Each of the legs 473, 475, and 477 may be disposed to correspond to an angle formed between the plurality of fastening holes 314, 316, and 318 (see FIG. 4). In addition, the plurality of fastening holes 314, 316, and 318 may be disposed to form different angles from each other.

As shown in FIGS. 15 and 15, the plurality of legs 473, 475, and 477 may be formed to have the same shape. However, the shape of the legs are not limited thereto and may be varied if desired.

The clamp 470 may further include the mount portions 474, 476, and 478 extending from the legs 473, 475, and 477, respectively. The plurality of mount portions 474, 476, and 478 may be formed of a plate extending parallel to the main body portion 471 in a radial direction of the main body portion 471.

Each of the mount portions 474, 476, and 478 may be formed in a different shape or size. Accordingly, the clamp 470 may be prevented from being erroneously assembled.

The through holes 474*a*, 476*a*, and 478*a* may be disposed at the mount portions 474, 476, and 478, respectively. The fastening members 484, 486, and 488, (see FIG. 4) may penetrate through the through holes 474*a*, 476*a*, and 478*a*, respectively. Accordingly, the clamp 470 is mounted on the cylinder block 310 (see FIG. 4).

The plurality of legs 473, 475, and 477 and the plurality of mount portions 474, 476, and 478 may be collectively called a "plurality of bridge parts." Here, a bridge part may collectively represent one leg and one mount portion extending from the one leg. For example, the leg 473 and the mount portion 474 extending from the leg 473 may be collectively called a first bridge part.

Hereinafter, a structure for fixing the suction/discharge unit 400 to the cylinder block 310 using the clamp 470 will be described in detail.

Figure 17:
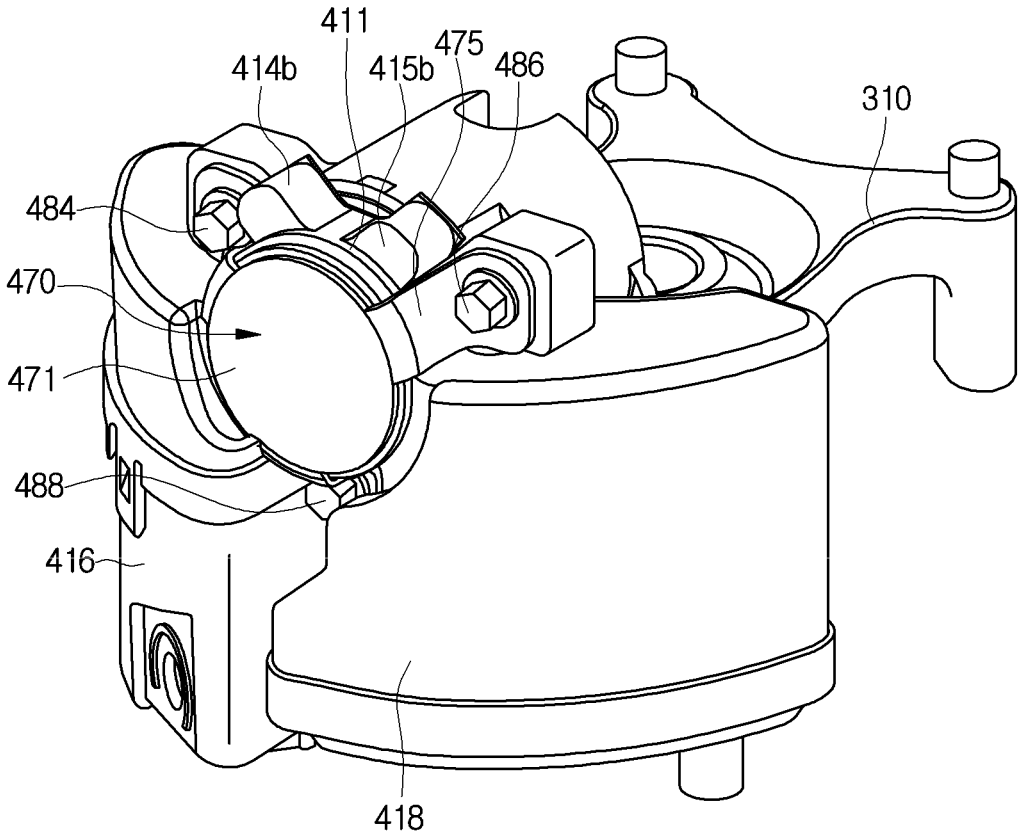
FIGS. 17 and 18 are views illustrating a state in which the suction/discharge unit in FIG. 4 is coupled to the muffler assembly.
Figure 18:
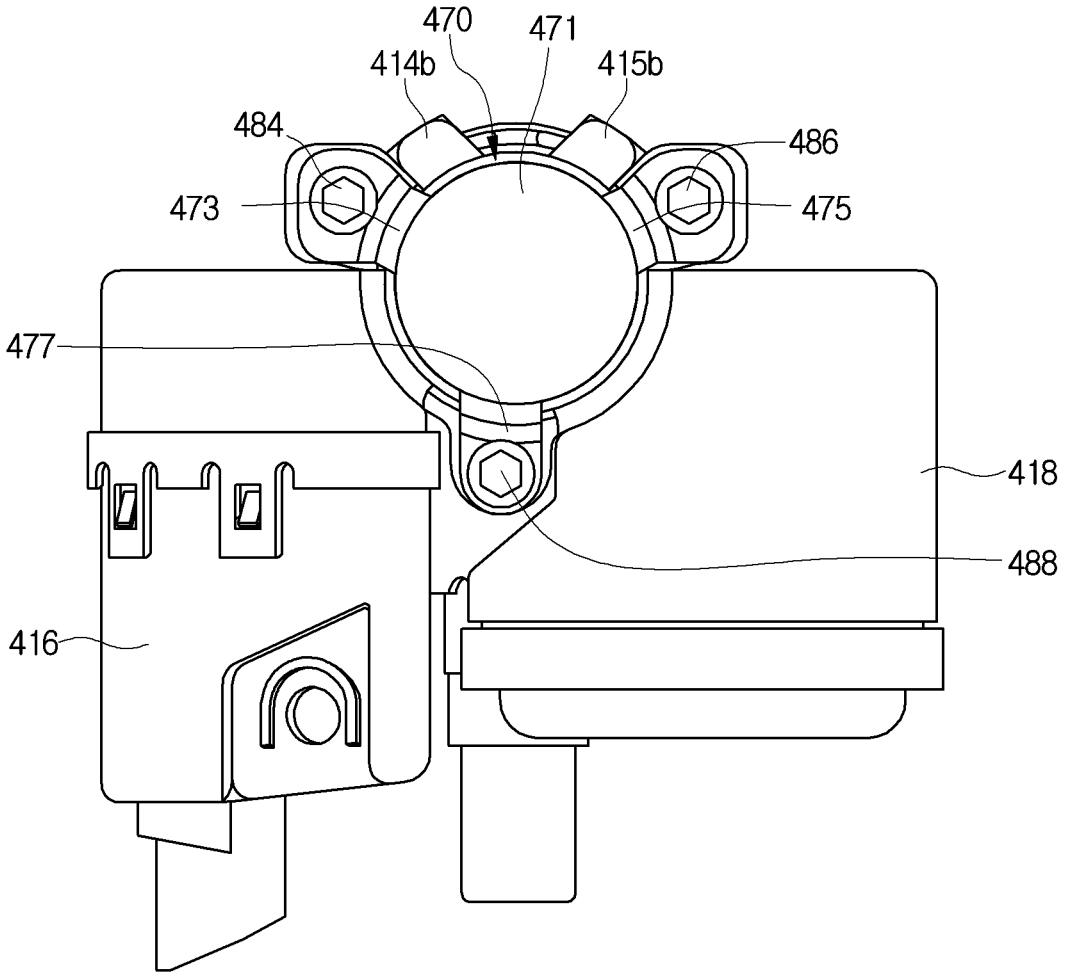

FIGS. 17 and 18 are views illustrating a state in which the suction/discharge unit in FIG. 4 is coupled to the muffler assembly.

Referring to FIGS. 17 and 18, when the clamp 470 is fastened to the cylinder block 310, the clamp 470 may surround and support the suction/discharge part 411. Specifically, the main body portion 471 may be disposed to come in contact with the front surface portion 419 (see FIG. 4) formed in front of the suction/discharge part 411, and the plurality of legs 473, 475, and 477 may be disposed to surround the outer circumferential surface of the suction/discharge part 411.

The first leg 473 is disposed between the first protrusion 414*b* and the suction muffler 416. In addition, the second leg 475 is disposed between the second protrusion 415*b* and the discharge muffler 418. The third leg 477 is disposed between the suction muffler 416 and the discharge muffler 418.

In this way, the reciprocating compressor 10 according to the present embodiment can fix the suction/discharge unit 400 formed of a plurality of members to the cylinder block 310 using the clamp 470.

Consequently, a separate fastening member connecting each member is not required, thereby simplifying a coupling structure among components of the reciprocating compressor 10.

Although embodiments have been described with reference to a number of illustrative embodiments thereof, it should be understood that numerous other modifications and embodiments can be devised by those skilled in the art that will fall within the spirit and scope of the principles of the disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A reciprocating compressor, comprising:

a housing shell;

a motor to provide a driving force;

a compressor connected to the motor and including a cylinder configured to form a compression space for compressing a refrigerant by a linear reciprocating motion of a piston;

a suction/discharge assembly provided at one end of the cylinder, and configured to supply the refrigerant suctioned into the housing shell to the cylinder or discharge the refrigerant compressed in the cylinder to the outside of the housing shell, the suction/discharge assembly including a suction/discharge part, the suction/discharge part having a refrigerant inlet for supplying the refrigerant to the cylinder and a refrigerant outlet for discharging the refrigerant compressed in the cylinder;

a clamp fixing the suction/discharge assembly to the compressor, the clamp extending around the suction/discharge part, the clamp including:

a main body portion disposed at a front side of the suction/discharge assembly to fix the suction/discharge assembly;

at least three legs configured to extend towards the cylinder from an outer circumferential surface of the main body portion; and a mount portion bent from each of the at least three legs, each mount portion having a through hole in which a fastener passes through and is coupled to the cylinder; and an elastic member disposed between a rear surface of the main body of the clamp and a front surface of the suction/discharge part.

2. The reciprocating compressor according to claim 1, wherein the suction/discharge assembly includes:

a suction muffler connected to the suction/discharge part to suction the refrigerant into the housing shell; and a discharge muffler connected to the suction/discharge part to discharge the compressed refrigerant to the outside of the housing shell, wherein at least one leg of the at least three legs is disposed between the suction muffler and the discharge muffler.

3. The reciprocating compressor according to claim 2, wherein the elastic member is disposed to face the clamp, one side of the elastic member being supported by the suction/discharge part and the other side of the elastic member being supported by the clamp, such that the muffler assembly and the cylinder are in close contact with each other by an elastic force of the elastic member.

4. The reciprocating compressor according to claim 1, wherein each of the mount portions are formed to have a different shape or size from one another.

* * * * *